US007494211B2

(12) United States Patent
Murakami

(10) Patent No.: US 7,494,211 B2
(45) Date of Patent: Feb. 24, 2009

(54) DROPLET DISCHARGE APPARATUS

(75) Inventor: Atsushi Murakami, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 64 days.

(21) Appl. No.: 11/594,549

(22) Filed: Nov. 8, 2006

(65) Prior Publication Data

US 2007/0285474 A1 Dec. 13, 2007

(30) Foreign Application Priority Data

Jun. 8, 2006 (JP) ..... 2006-159813

(51) Int. Cl.
*B41J 2/17* (2006.01)

(52) U.S. Cl. ..... 347/84; 347/85

(58) Field of Classification Search ..... 347/40–43, 347/84–85, 86

See application file for complete search history.

(56) References Cited

U.S. PATENT DOCUMENTS

2005/0062815 A1* 3/2005 Yoshihira et al. ..... 347/89

FOREIGN PATENT DOCUMENTS

JP 2004-160907 6/2004

* cited by examiner

*Primary Examiner*—Lamson D Nguyen
(74) *Attorney, Agent, or Firm*—Fildes & Outland, P.C.

(57) ABSTRACT

A droplet discharge apparatus comprising: a plurality of droplet discharge units, which further include: a plurality of droplet discharge heads for discharging droplets from nozzles; an inflow path provided with a common flow path for supplying liquid to the plurality of droplet discharge heads; and a liquid storage portion for supplying a stored liquid to the inflow path and generating negative pressure in the droplet discharge heads, liquid storage sections being communicated by a communication path, is provide.

15 Claims, 7 Drawing Sheets

DROPLET DISCHARGE APPARATUS

BACKGROUND

1. Technical Field

The present invention relates to a droplet discharge apparatus for discharging droplets.

2. Related Art

In an ink jet recording device for discharging ink drops from nozzles and recording an image on paper, higher printing speed is achieved by using an ink jet recording head having the width of paper used. In such an ink jet recording device, the ink jet recording head becomes longer as the paper width becomes larger. With a longer ink jet recording head, a common liquid chamber for storing the ink supplied from a sub-tank and for supplying the ink to the nozzles also becomes long. That is, since the pressure loss generated between the sub-tank and the nozzles increases, the supply of ink to the nozzles may be delayed and the discharge of ink may become unstable.

SUMMARY

According to an aspect of the present invention, there is provided a droplet discharge apparatus comprising: a plurality of droplet discharge units, which further include: a plurality of droplet discharge heads for discharging droplets from nozzles; an inflow path provided with a common flow path for supplying liquid to the plurality of droplet discharge heads; and a liquid storage portion for supplying a stored liquid to the inflow path and generating negative pressure in the droplet discharge heads, liquid storage sections being communicated by a communication path.

BRIEF DESCRIPTION OF THE DRAWINGS

An exemplary embodiment of the present invention will be described in detail based on the following figures, wherein.

DETAILED DESCRIPTION

Figure 1:
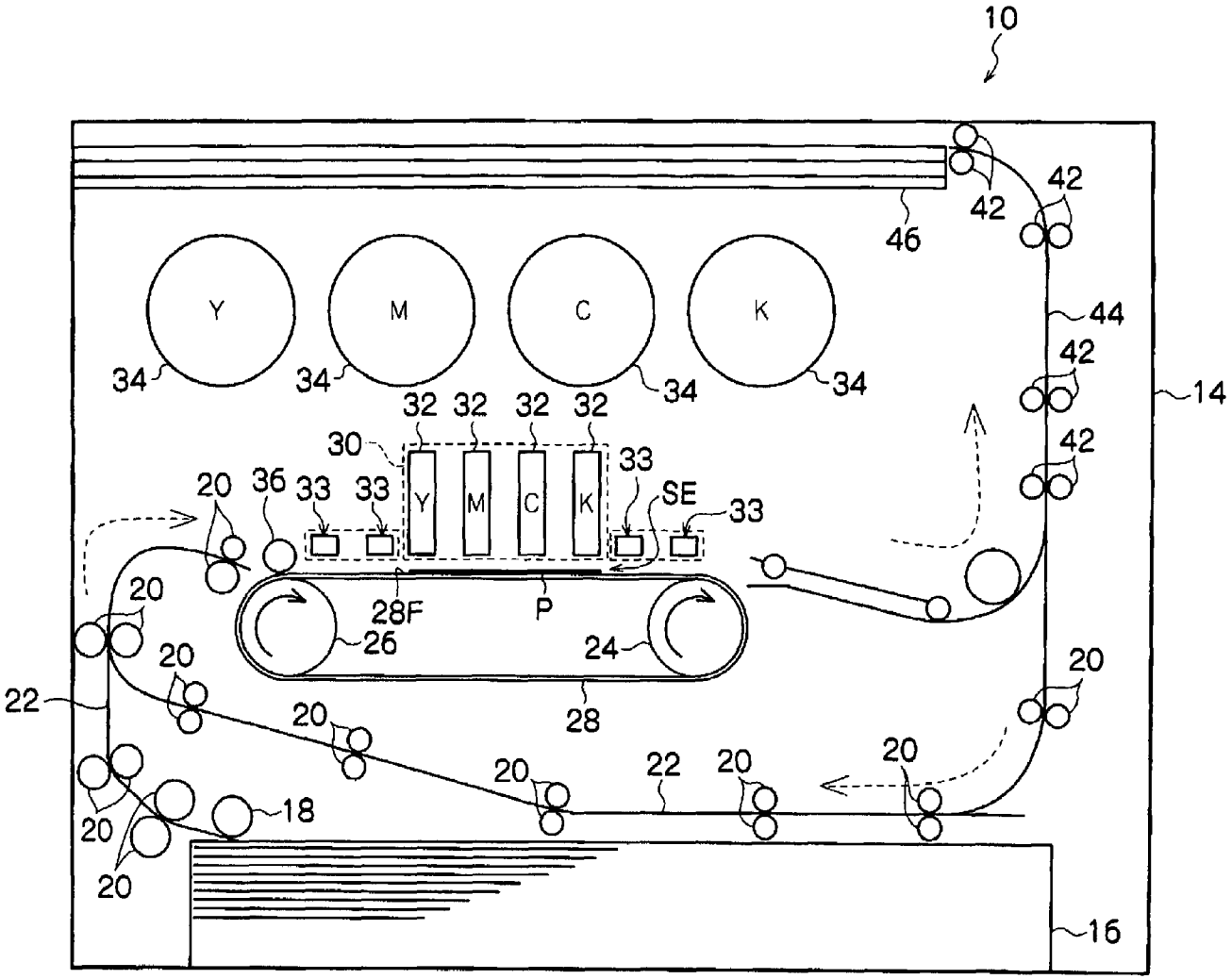
FIG. 1 is a schematic view of an ink jet recording device mounted with an ink supply device of a first embodiment of the present invention.

First, an ink jet recording device 10 serving as a droplet discharge apparatus according to a first embodiment of the present invention will be described. FIG. 1 shows the ink jet recording device 10.

As shown in FIG. 1, a paper feeding tray 16 is arranged at the lower part of a housing 14 of the ink jet recording device 10, where the paper stacked in the paper feeding tray 16 is taken out one sheet at a time by a pick up roll 18. The paper that has been taken out is conveyed by plural conveyor roll pairs 20 configuring a predetermined conveying path 22.

An endless conveying belt 28 stretched across a driving roll 24 and a driven roll. 26 is arranged above the paper feeding tray 16. A recording head array 30 is arranged above the conveying belt 28 and opposes a flat portion 28F of the conveying belt 28. The opposing region becomes a discharge region SE where an ink drop is discharged from the recording head array 30. The paper conveyed through the conveying path 22 reaches the discharge region SE while being held by the conveying belt 28, and is applied with ink drops corresponding to image information from the recording head array 30 while facing the recording head array 30.

In the present embodiment, the length of the effective recording region of the recording head array 30 is greater than or equal to the width of the paper (length in a direction orthogonal to the conveying direction), and ink jet recording heads (hereinafter, referred to as "recording heads") 32 serving as four droplet discharge heads respectively corresponding to the colors of yellow (Y), magenta (M), cyan (C) and black (K) are arranged in a line along the conveying direction, thus enabling a full color image to be recorded.

Each recording head 32 is controlled by a head drive controller (not shown). The head drive controller is configured, for example, to determine the discharge timing of ink drops or the ink discharge port (nozzle) to be used according to the image information and to provide a drive signal to the recording heads 32.

The recording head array 30 may be immovable in the direction orthogonal to the conveying direction, but if configured to be movable as necessary, an image with higher resolution can be recorded with multi-pass image recording, and defects of the recording heads 32 can be prevented from being reflected on recording results.

Figure 2:
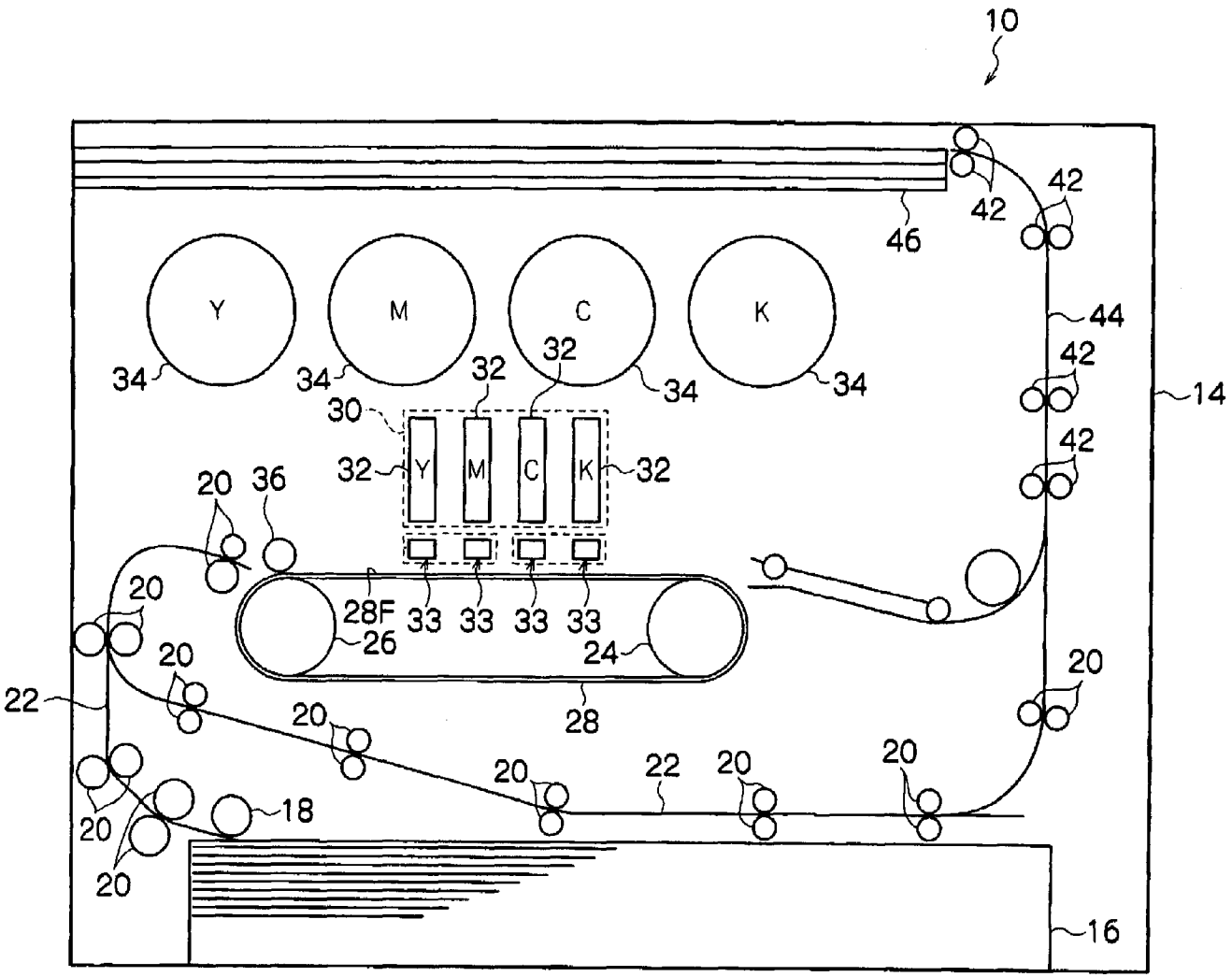
FIG. 2 is a schematic view of the ink jet recording device mounted with an ink supply device of the first embodiment of the present invention.

Four maintenance units 33 corresponding to the respective recording heads 32 are arranged on both sides of the recording head array 30. As shown in FIG. 2, when performing capping on the recording heads 32, the maintenance units 33 move the recording head array 30 upward, move into a gap formed between the recording head array 30 and the conveying belt 28, and perform a predetermined maintenance operation (suction, wiping, capping etc.) while facing a nozzle surface 32N (see FIG. 3).

Figure 3:
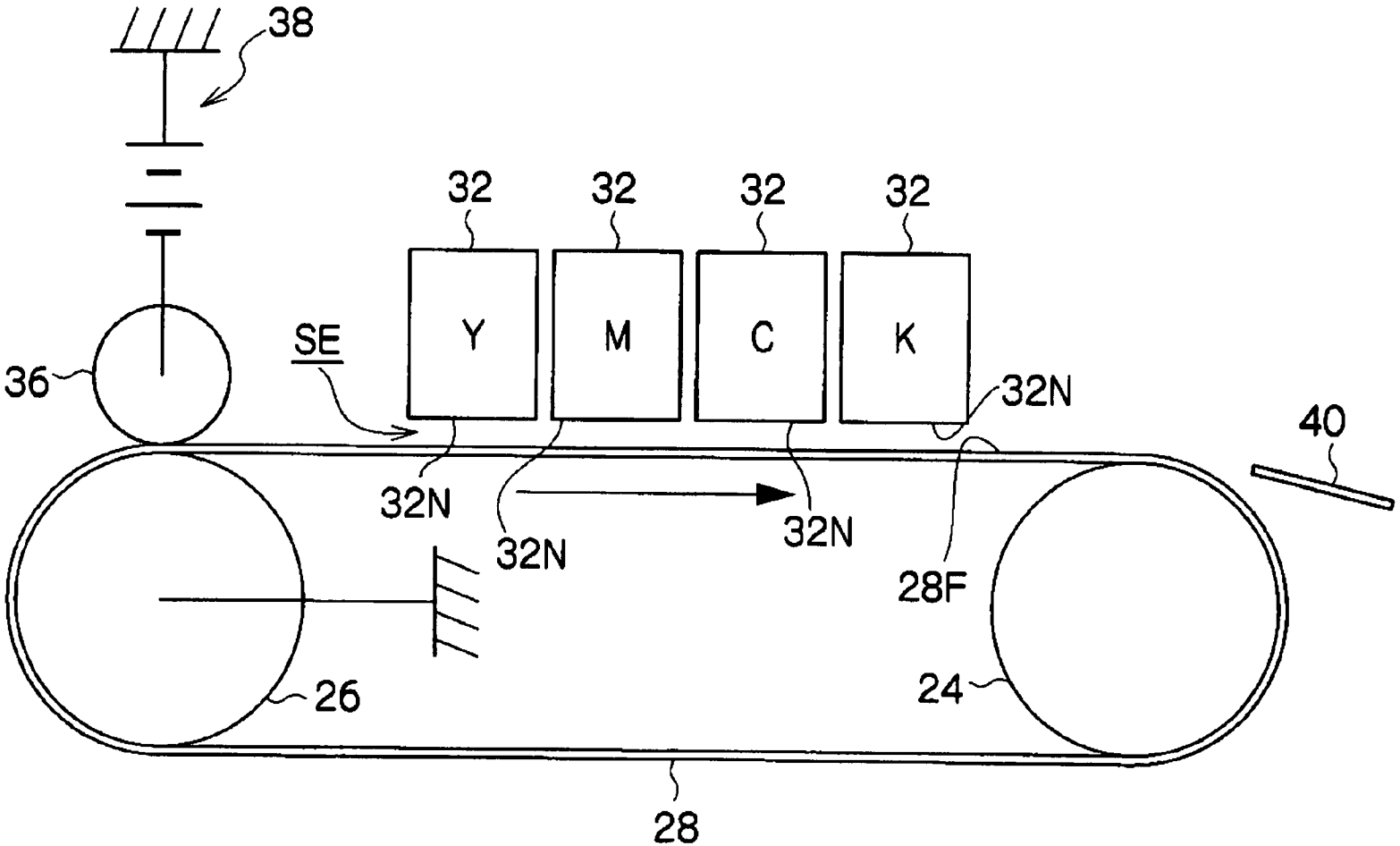
FIG. 3 is a schematic view of a printing section of the ink jet recording device mounted with the ink supply device of the first embodiment of the present invention.

As shown in FIG. 3, a charging roll 36 connected with a power source 38 is arranged at the upstream side of the recording head array 30. The charging roll 36 is driven while sandwiching the conveying belt 28 and the paper with the driven roll 26, and is movable between a pressing position where the paper is pressed against the conveying belt 28 and a removed position where the driven roll 26is removed from the conveying belt 28. Since a predetermined electric potential is produced with the grounded driven roll 26 at the pressing position, an electric charge is applied to electrostatically attract the paper to the conveying belt 28.

A separation plate 40 is arranged at the downstream side of the recording head array 30 to separate the paper from the conveying belt 28. The separated paper is conveyed by plural paper exit roll pairs 42 configuring a paper exit path 44 at the downstream side of the separation plate 40 (see FIG. 1 and FIG. 2), and stacked to a paper stack tray 46 provided at the upper part of the housing 14.

As shown in FIGS. 1 and 2, main tanks (ink tanks) 34 storing the ink of the respective colors are arranged above the recording head array 30. The main tanks 34 are connected to respective recording heads 32 via sub-tanks 60, 62 serving as a liquid storing section (described in the following), and the ink is supplied from each main tank 34 to each recording head 32.

Figure 4:
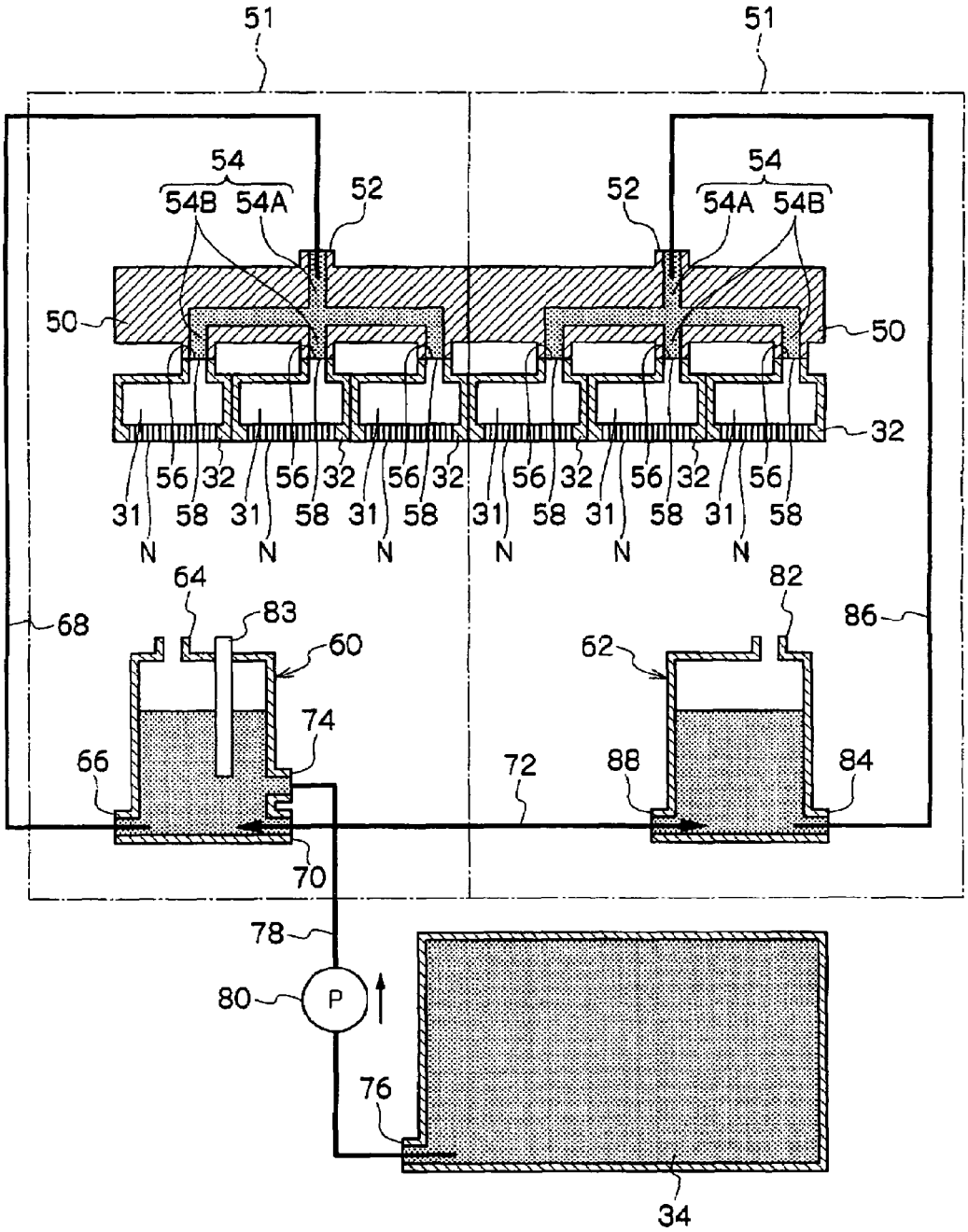
FIG. 4 is a schematic view showing the positional relationship of a main tank, a sub-tank, and a recording head mounted on the ink jet recording device of the first embodiment.

As shown in FIG. 4, the recording heads 32 in which a plurality of nozzles N are arrayed along the width direction (direction orthogonal to the conveying direction) of the paper P are arranged in plural (three in the present embodiment) along the width direction of the paper P. A flow path member 50 is provided to bridge over the upper part of the three recording heads 32. In FIG. 4, two recording head units 51 each configured by three recording heads 32, the flow path member 50 and the sub-tank 60 (62) are shown.

An ink inflow port 52 is formed at the upper wall of the flow path member 50. The ink inflow port 52 is connected to the sub-tank 60 via an ink supply path 68, and the ink stored in the sub-tank 60 is supplied to the flow path member 50 through the ink inflow port 52.

An ink flow path 54 is formed in the flow path member 50. The ink flow path 54 is configured by a main flow section 54A communicating with the ink inflow port 52 and three branched flow sections 54B branched downward from the main flow section 54A. The branched flow sections 54B communicate with ink supply ports 56 formed at the bottom surface of the flow path member 50.

The ink supply ports 56 communicate with an ink supply port 58 of each recording head 32. The ink supplied from the ink inflow port 52 is thus branched from the main flow section 54A to the branched flow sections 54B and supplied from the respective ink supply ports 58 to the ink pools 31 of the recording heads 32.

The sub-tanks 60 and 62 are arranged below the recording heads 32. In FIG. 4, the sub-tanks 60 and 62 are arranged immediately below the recording heads 32 for the sake of convenience of explanation, but in practice, the paper conveying section is arranged in this position (immediately below the recording heads 32), and thus the sub-tanks 60 and 62 are arranged at a position shifted from the position immediately below the recording heads 32.

Vent holes 64, 82 are formed in the upper walls of the sub-tanks 60, 62. The vent holes 64, 82 are always left open to the atmosphere, and thus the liquid levels of the ink in the sub-tanks 60 and 62 are in a state applied with atmospheric pressure.

An ink supply port 66 is formed in the side wall of the sub-tank 60. The ink supply port 66 and the ink inflow port 52 formed in the flow path member 50 are connected by an ink supply path 68. Thus, when ink is discharged from the nozzle N and negative pressure is generated in the recording head 32, the ink in the sub-tank 60 is supplied to the flow path member 50 via the ink supply path 68.

An ink supply port 84 is formed in the side wall of the sub-tank 62. The ink supply port 84 and the ink inflow port 52 formed in the flow path member 50 are connected by an ink supply path 86. Thus, when ink is discharged from the nozzle N and negative pressure is generated in the recording head 32, the ink in the sub-tank 62 is supplied to the flow path member 50 via the ink supply path 86.

An ink communication port 70 is formed in the side wall of the sub-tank 60. The ink communication port 70 is connected to an ink communication port 88 formed in the other sub-tank 62 by an ink communication path 72.

An ink inflow port 74 is formed in the sub-tank 60. In FIG. 4, the ink inflow port 74 is positioned above the ink communication port 70, but in practice, the ink inflow port 74 is arranged at the same height as the ink communication port 70 further toward the interior of the drawing than the ink communication port 70. The ink inflow port 74 is connected to an ink supply port 76 formed in the main tank 34 by an ink communication path 78.

An ink supply pump 80 is arranged on the ink communication path 78. When the liquid level of the ink in the sub-tank 60 is detected to have lowered to a defined position by a liquid level sensor 83 arranged in the sub-tank 60, the ink supply pump 80 is driven to supply the ink from the main tank 34 to the sub-tank 60 through the ink communication path 78.

The mechanism of the first embodiment of the present invention is described below.

The ink is supplied from the sub-tanks 60, 62, which are left open to the atmosphere, to the recording heads 32, which are arranged in a line. The sub-tanks 60, 62 are communicated by the ink communication path 72, and when the amount of ink consumed in the respective sub-tanks 60 and 62 becomes different, the liquid level difference is generated between the sub-tanks 60 and 62 and ink flows from one of the sub-tanks 60, 62 (from the sub-tank with decreased ink) to the other of the sub-tanks 60, 62.

Accordingly, the height of the ink level is always substantially equalized between the sub-tanks 60 and 62, and thus the back pressure generated at each recording head 32 is equalized, and variation in the ink drops discharged from the nozzles N is suppressed.

The flow path length between the sub-tanks 60, 62 and the recording heads 32 is shorter compared to a case when ink is supplied from one sub-tank to plural recording head units since the sub-tanks 60 and 62 are arranged with respect to each recording head unit 51. Thus, the flow path resistance of the ink flowing from the sub-tanks 60, 62 to the recording heads 32 is lowered, whereby the discharge of the ink is prevented from being unstable, and the discharge forces among the nozzles N of the ink are prevented from being uneven.

Furthermore, compact sub-tanks 60, 62 may be used since the number of the recording heads 32 for supplying ink is small. The sub-tanks 60, 62 may then be disposed in a narrow space, and the space inside the ink jet recording device 10 may be effectively utilized. Therefore, miniaturization of the ink jet recording device 10 becomes possible.

A configuration of arranging, in the arraying direction of the nozzles N, two recording head units 51, each configured by the recording heads 32, the flow path member 50, and the sub-tank 60 (62) has been described in the present embodiment, but the configuration is not limited thereto.

In the present embodiment, description has been made by using the sub-tanks 60 and 62 with the vent holes 64, 82 formed in the upper wall thereof, but the present invention is also applicable when using a freely deformable bag-shaped sub-tank such as an ink pack, that is, when a vent hole is not formed in the sub-tank.

The ink jet recording device according to a second embodiment of the present invention will now be described. Description of components similar to the first embodiment will be omitted.

Figure 5:
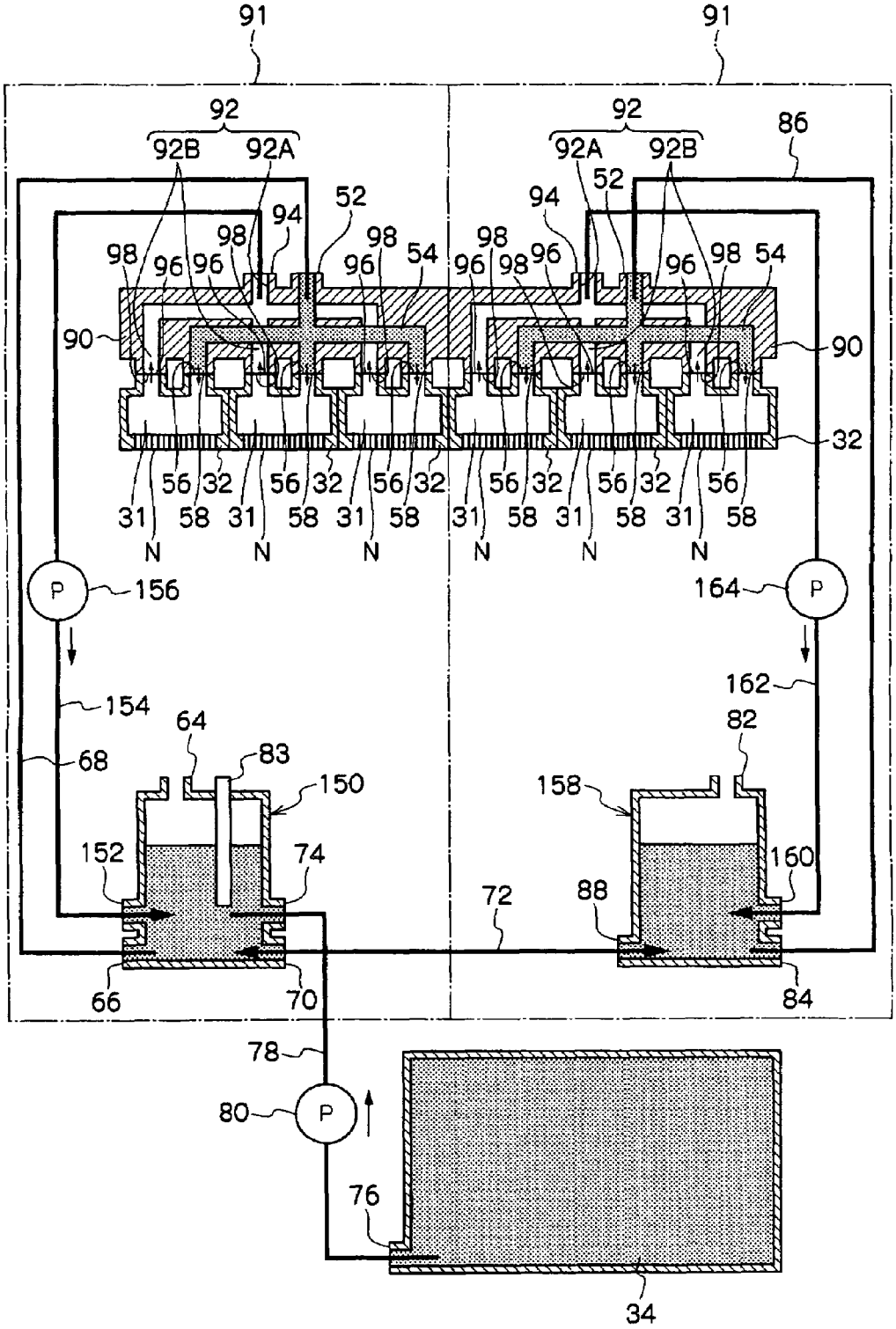
FIG. 5 is a schematic view showing the positional relationship of a main tank, a sub-tank, and a recording head mounted on the ink jet recording device of a second embodiment.

In FIG. 5, two recording head units 91, each configured by three recording heads 32, a flow path member 90 provided so as to bridge over the upper part of the recording heads 32, and a sub-tank 150 (158) connected to the flow path member 90 and arranged below the recording head 32 are shown.

An ink backflow path 92 is formed in the flow path member 90 separate from the ink flow path 54. The ink backflow path 92 is configured by a main flow section 92A communicating with an ink outflow port 94 formed in the upper wall of the flow path member 90, and three branched flow sections 92B branched downward from the main flow section 92A. The branched flow sections 92B communicate with an ink inflow port 96 formed at the bottom surface of the flow path member 90.

The ink inflow port 96 is connected to an ink outflow port 98 of each recording head 32, and the ink in ink pools 31 of the recording heads 32 flows into the main flow section 92A from the ink outflow ports 98 via the branched flow sections 92B.

An ink backflow port 152 is formed in the side wall of the sub-tank 150. The ink backflow port 152 is connected to the ink outflow port 94 of the flow path member 90 by an ink circulating path 154. A circulating pump 156 is arranged on the ink circulating path 154. When the circulating pump 156 is driven to make the ink in the ink pools 31 flow back to the sub-tank 150 via the ink backflow path 92, the ink flows from the sub-tank 150 to the ink flow path 54 via the ink supply path 68, and thus the ink circulates between the sub-tank 150 and the recording heads 32.

Similarly, an ink backflow port 160 is formed in the side wall sub-tank 158. The ink backflow port 160 is connected to the ink outflow port 94 of the flow path member 90 by an ink circulating path 162. A circulating pump 164 is arranged on the ink circulating path 162. When the circulating pump 164 is driven to make the ink in the ink pools 31 flow back to the sub-tank 158 via the ink backflow path 92, the ink flows from the sub-tank 158 to the ink flow path 54 via the ink supply path 86, and thus the ink circulates between the sub-tank 158 and the recording heads 32.

Therefore, air bubbles generated in the recording heads 32 are sent to the sub-tanks 150 and 158, and exhausted to the atmosphere through the vent holes 64, 82 by circulating the ink between the sub-tanks 150, 158 and the recording heads 32. Furthermore, sedimentation of pigments and the like is avoided since the ink is stirred by circulating the ink.

The ink jet recording device according to a third embodiment of the present invention will now be described. Description of components similar to the first and second embodiments will be omitted.

Figure 6:
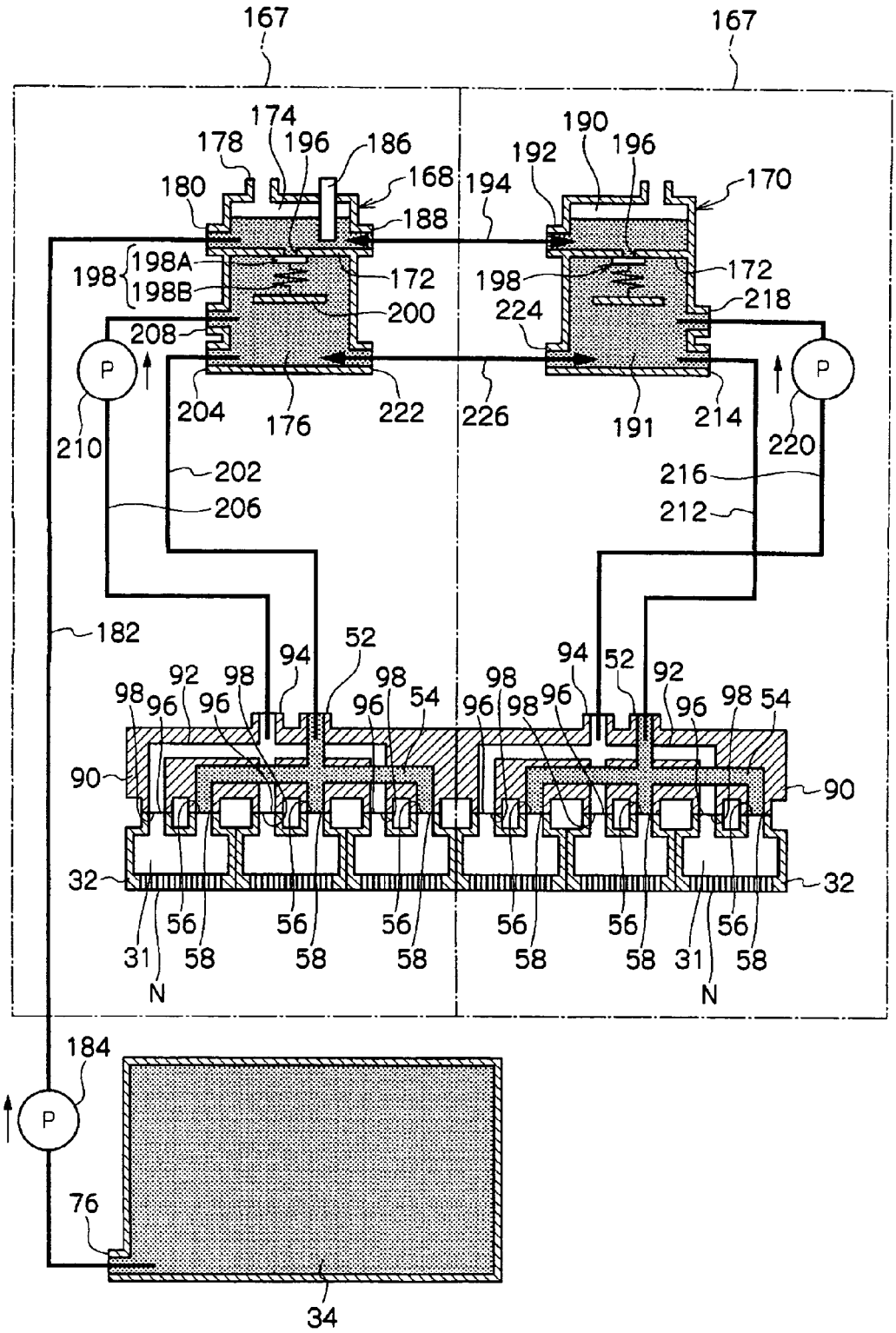
FIG. 6 is a schematic view showing the positional relationship of a main tank, a sub-tank, and a recording head mounted on the ink jet recording device of a third embodiment.

FIG. 6 shows two recording head units 167, each configured by three recording heads 32, the flow path member 90 provided so as to bridge over the upper part of the recording heads 32, and a sub-tank 168 (170) connected to the flow path member 90 and arranged above the recording heads 32.

First, the configuration of the sub-tank 168 will be described. A wall 172 is arranged in the sub-tank 168 to divide the interior section into two parts in the vertical direction. Thus, an ink storage chamber 174 for storing the ink supplied from the main tank 34, and an ink supply chamber 176 supplied with ink from the ink storage chamber 174 and supplying the ink to the recording head 32 are formed in the sub-tank 168.

A vent hole 178 is formed in the upper wall of the ink storage chamber 174. The vent hole 178 is always left open to the atmosphere, and thus the liquid level of the ink in the ink storage chamber 174 is in a state applied with atmospheric pressure.

An ink inflow port 180 is formed in the side wall of the ink storage chamber 174. The ink inflow port 180 is connected to an ink supply port 76 formed in the main tank 34 by an ink communication path 182.

An ink supply pump 184 is arranged on the ink communication path 182. When the liquid level of the ink in the ink storage chamber 174 is detected to have lowered to a predetermined position by a liquid level sensor 186 arranged in the ink storage chamber 174, the ink supply pump 184 is driven to supply the ink from the main tank 34 to the ink storage chamber 174 via the ink communication path 182.

An ink communication port 188 is formed in the side wall of the ink storage chamber 174, and is connected to an ink communication port 192 formed in an ink storage chamber 190 of the sub-tank 170 via an ink communication path 194. Thus, when the liquid level difference is generated due to a difference in the ink consumption amount between the ink storage chambers 174 and 190, the ink flows from one to the other of the ink storage chambers 174, 190, and the liquid level heights of the ink in the ink storage chambers 174 and 190 become the same.

Flow communication hole 196 is formed in the wall 172. The differential pressure regulating valve 198 is arranged on the lower surface (ink supply chamber 176 side) of the flow communication hole 196. A differential pressure regulating valve 198 is configured by a plate 198A for closing the flow communication hole 196 and a spring 198B having one end coupled to the plate 198A. The other end of the spring 198B is supported at a plate strip 200 integrally arranged in the sub-tank 168, and biases the plate 198A in the upward direction (toward the flow communication hole 196).

The ink supply chamber 176 is sealed when the flow communication hole 196 is closed by the plate 198A, and ink does not flow from the ink storage chamber 174 to the ink supply chamber 176. When ink is discharged from the nozzles N and negative pressure is generated in the ink supply chamber 176, the plate 198A moves downward due to the differential pressure thereby opening the flow communication hole 196, and ink flows from the ink storage chamber 174 to the ink supply chamber 176. When ink flows from the ink storage chamber 174 to the ink supply chamber 176, the differential pressure between the ink storage chamber 174 and the ink supply chamber 176 is removed, and the plate 198A again closes the flow communication hole 196 due to the biasing force of the spring 198B.

The air bubbles generated in the ink storage chamber 174 are collected at the upper part of the ink storage chamber 174 (in the vicinity of the wall 172), and thus when the flow communication hole 196 is opened and the ink flows from the ink storage chamber 174 to the ink supply chamber 176, the air bubbles are sent from the flow communication hole 196 to the ink storage chamber 174, and exhausted into the atmosphere from the vent hole 178.

An ink supply port 204 connected to the ink inflow port 52 of the flow path member 90 via an ink supply path 202 and an ink backflow port 208 connected to the ink outflow port 94 of the flow path member 90 via an ink backflow path 206 are formed in the side wall of the ink supply chamber 176.

A circulating pump 210 is arranged on the ink backflow path 206. When the circulating pump 210 is driven to make the ink in the ink pools 31 flow back to the ink supply chamber 176 via the ink backflow path 92, the ink flows from the ink supply chamber 176 to the ink flow path 54 via the ink supply path 202, and thus the ink circulates between the ink supply chamber 176 and the recording heads 32.

An ink communication port 222 is formed in the side wall of the ink supply chamber 176 of the sub-tank 168, and is connected to an ink communication port 224 formed in the side wall of the ink supply chamber 191 of the sub-tank 170 via an ink communication path 226.

Similarly, an ink supply port 214 connected to the ink inflow port 52 of the flow path member 90 via an ink supply path 212 and an ink backflow port 218 connected to the ink outflow port 94 of the flow path member 90 via an ink backflow path 216 are formed on the side wall of the ink supply chamber 191 of the sub-tank 170.

A circulating pump 220 is arranged on the ink backflow path 216. When the circulating pump 220 is driven to make the ink in the ink pools 31 flow back to the ink supply chamber 191 via the ink backflow path 92, the ink flows from the ink supply chamber 191 to the ink flow path 54 via the ink supply path 212, and thus the ink circulates between the ink supply chamber 191 and the recording heads 32.

The mechanism according to the third embodiment of the present invention is described below.

When ink is discharged from the nozzles N of the recording heads 32, negative pressure is generated in the recording heads 32, and the ink in the ink supply chambers 176, 191 of the sub-tanks 168, 170 flows into the recording heads 32. Negative pressure is thereby generated in the ink supply chambers 176, 191, the plate 198A of the differential pressure regulating valve 198 moves downward thereby opening the flow communication hole 196, and ink flows from the ink storage chambers 174, 190 to the ink supply chambers 176, 191.

When the amount of ink discharged from the nozzles N differs, the amount of ink supplied from the ink supply chamber 176 of the sub-tank 168 and the ink supply chamber 191 of the sub-tank 170 differs, thereby generating the liquid level difference between the ink storage chambers 174, 190 for supplying ink to the ink supply chambers 176, 191, and thus the ink flows from one to the other of the ink storage chambers 174, 190 via the ink communication path 194. The heights of the ink levels are thus always equalized between the ink storage chambers 174, 190.

Furthermore, when the pressure applied to the ink in the ink supply chamber 176 of the sub-tank 168 and in the ink supply chamber 191 of the sub-tank 170 varies due to variation and the like of the biasing forces of the springs 198B of the differential pressure regulating valve 198 arranged in the sub-tank 168 and of the differential pressure valve 198 arranged in the sub-tank 170, the ink flows from one to the other of the ink supply chambers 176, 191 via the ink communication path 226. The pressure applied to the ink in the ink supply chambers 176, 191 thus always remains constant, and the back pressure applied to the ink in the recording heads 32 also remains constant. Variation in the ink drops discharged from the nozzles N is thus less likely to occur.

The sub-tanks 168, 170 do not need to be positioned below the recording heads 32 since the ink supply chambers 176, 191 of the sub-tanks 168, 170 are closed by the differential pressure regulating valve 198, thereby increasing the degree of freedom of arrangement.

Therefore, the sub-tanks 168, 170 may be arranged in an empty space in the ink jet recording device, the space in the device may be effectively used, and further, compact sub-tanks 168, 170 may be used since the number of recording heads 32 supplying ink is small. The sub-tanks 168, 170 may then be installed in a narrow space, and the space inside the ink jet recording device 10 can be effectively used. Miniaturization of the ink jet recording device 10 thus becomes possible.

The ink jet recording device according to a fourth embodiment of the present invention will now be described. Description of components similar to the first and second embodiments will be omitted.

Figure 7:
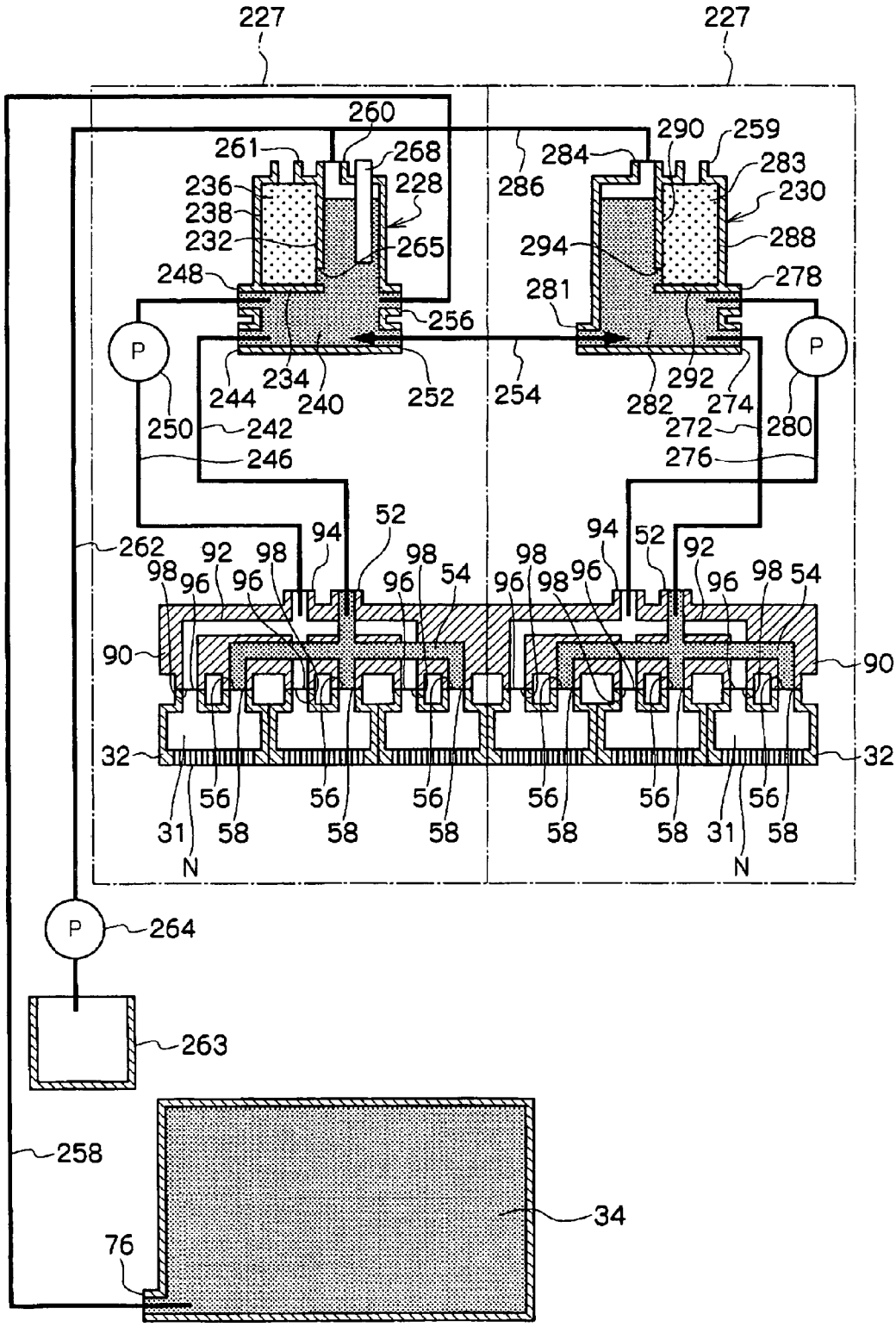
FIG. 7 is a schematic view showing the positional relationship of a main tank, a sub-tank, and a recording head mounted on the ink jet recording device of a fourth embodiment.

FIG. 7 shows two recording head units 227, each configured by three recording heads 32, the flow path member 90 provided so as to bridge over the upper part of the recording heads 32, and a sub-tank 228 (230) connected to the flow path member 90 and arranged above the recording heads 32.

First, the configuration of the sub-tank 228 will be described. A partition plate 232 parallel to the side wall of the sub-tank 228, and a dividing wall 234 parallel to the bottom surface of the sub-tank 228 are respectively arranged at substantially the middle of the sub-tank 228, which partition plate 232 and the dividing wall 234 form a porous object accommodating section 238 for accommodating a porous object 236 in the sub-tank 228. An ink storage chamber 240 having a substantially L shaped cross section is formed in the sub-tank 228 with the porous object accommodating section 238.

An ink supply port 244 connected to the ink inflow port 52 of the flow path member 90 via an ink supply path 242 and an ink circulating port 248 connected to the ink outflow port 94 of the flow path member 90 via an ink backflow path 246 are provided at the side wall of the ink storage chamber 240.

A circulating pump 250 is arranged on the ink backflow path 246. When the circulating pump 250 is driven to make the ink in the ink pools 31 flow back to the ink storage chamber 240 via the ink backflow path 92, the ink flows from the ink storage chamber 240 to the ink flow path 54 via the ink supply path 242, and thus the ink circulates between the ink storage chamber 240 and the recording heads 32.

An ink communication port 252 is formed in the side wall of the ink storage chamber 240 of the sub-tank 228, and is connected to an ink communication port 281 formed in the side wall of an ink storage chamber 282 of the sub-tank 230 via an ink communication path 254.

An ink waste port 260 is formed in the upper wall of the ink storage chamber 240. The ink waste port 260 is connected to a waste ink tank 263 arranged below the sub-tank 228 via an ink flow communication path 262.

An ink supply pump 264 is arranged on the ink flow communication path 262. When the liquid level of the ink in the ink storage chamber 240 is detected to have lowered to a predetermined position by a liquid level sensor 268 arranged in the ink storage chamber 240, the ink supply pump 264 is driven, and the air in the ink storage chamber 240 of the sub-tank 228 is suctioned through the ink flow communication path 262. Negative pressure is then generated in the ink storage chamber 240, and the ink in the main tank 34 flows into the ink storage chamber 240 through the ink inflow port 256 formed in the side wall of the ink storage chamber 240 via the ink communication path 258.

Due to the driving of the ink supply pump 264, air bubbles generated in the ink storage chamber 240 and air bubbles that have entered the ink storage chamber 240 through the porous object 236 are sent to the waste ink tank 263 with the suctioned air (ink), and removed from the ink storage chamber 240.

A port 265 is formed in the vicinity of the dividing wall 234 of the partition plate 232 forming the porous object accommodating section 238. Thus, the ink in the ink storage chamber 240 enters the porous object accommodating section 238 from the port 265 and is absorbed by the porous object 236, thereby generating the back pressure in the ink storage chamber 240. Thus, the ink does not leak from the nozzles N even if the sub-tank 228 is arranged above the recording heads 32.

Similarly, a porous object accommodating section 288 for accommodating a porous object 283 is formed in the sub-tank 230 by a partition plate 290 and a dividing wall 292. An ink storage chamber 282 is formed in the sub-tank 230 with the porous object accommodating section 288. An ink communication port 281 is formed in the side wall of the ink storage chamber 282, as described above, and is supplied with the ink from the ink storage chamber 240 of the sub-tank 228 via the ink communication path 254 connected to the ink communication port 281.

A port 294 is formed in the vicinity of the dividing wall 292 of the partition plate 290 forming the porous object accommodating section 288. Thus, the ink in the ink storage chamber 282 enters the porous object accommodating section 288 from the port 294 and is absorbed by the porous object 283, thereby generating the back pressure in the ink storage chamber 282.

An ink supply port 274 connected to the ink inflow port 52 of the flow path member 90 via an ink supply path 272 and an ink circulating port 278 connected to the ink outflow port 94 of the flow path member 90 via an ink backflow path 276 are formed in the side wall of the ink storage chamber 282.

A circulating pump 280 is arranged on the ink backflow path 276. When the circulating pump 280 is driven to make the ink in the ink pools 31 flow back to the ink storage chamber 282 via the ink backflow path 92, the ink flows from the ink storage chamber 282 to the ink flow path 54 via the ink supply path 272, and thus the ink circulates between the ink storage chamber 282 and the recording heads 32.

An ink waste port 284 is formed in the upper wall of the ink storage chamber 282. The ink waste port 284 is connected via an ink flow communication path 286 to the ink flow communication path 262 connecting the sub-tank 228 and the waste ink tank 263.

Due to the driving of the ink supply pump 264, the air in the ink storage chamber 282 of the sub-tank 230 is suctioned through the ink flow communication path 286, and air bubbles that have entered the ink storage chamber 282 via the porous object 283 are sent to the waste ink tank 263 with the suctioned air (ink) and removed from the ink storage chamber 282.

The mechanism according to the fourth embodiment of the present invention is described below.

When the ink is discharged from the nozzles N of the recording heads 32, negative pressure is generated in the recording heads 32 and the ink in the ink storage chambers 240, 282 of the sub-tanks 228, 230 flows into the recording heads 32. Negative pressure is then generated in the ink storage chambers 240, 282, and the ink absorbed in the porous objects 236, 283 communicating with the atmosphere through the vent holes 261, 259 is supplied to the ink storage chambers 240, 282, thereby generating the back pressure in the ink storage chambers 240, 282.

When the amount of ink discharged from the nozzles N differs, the amount of ink supplied from the ink storage chamber 240 of the sub-tank 228 and the ink storage chamber 282 of the sub-tank 230 differs, and thus a pressure difference is generated between the ink storage chambers 240 and 282 and the ink flows from one to the other of the ink storage chambers 240, 282.

The height of the ink level is thus always equalized between the ink storage chambers 240 and 282, the back pressure generated at each recording head 32 becomes substantially even and, therefore, variation in the ink drops discharged from the nozzles N is less likely to occur.

When the pressure applied to the ink in the ink storage chamber 240 of the sub-tank 228 and of the ink storage chamber 282 of the sub-tank 230 varies due to the variation and the like of the porous object 236 arranged in the sub-tank 228 and the porous object 283 arranged in the sub-tank 230, the ink flows from one to the other of the ink storage chambers 240, 282 via the ink communication path 254. Thus, the pressure applied to the ink in the ink storage chambers 240, 282 is always substantially constant, and the back pressure applied to the ink in the recording heads 32 also remains substantially constant. Therefore, variation in the ink drops discharged from the nozzles N is thus less likely to occur.

Furthermore, the sub-tanks 228, 230 do not need to be arranged below the recording heads 32 since the ink storage chambers 240, 282 of the sub-tanks 228, 230 are closed, thereby increasing the degree of freedom of arrangement.

Therefore, the sub-tanks 228, 230 may be arranged in an empty space in the ink jet recording device, the space in the device may be effectively used, and further, compact sub-tanks 228, 230 may be used since the number of recording heads 32 supplying with ink is small. The sub-tanks 228, 230 may then be installed in a narrow space, and the space inside in the ink jet recording device 10 can be effectively used. Miniaturization of the ink jet recording device 10 thus becomes possible.

The foregoing descriptions of the exemplary embodiments of the present invention have been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A droplet discharge apparatus comprising:

a plurality of droplet discharge units, which further include:

a plurality of droplet discharge heads for discharging droplets from nozzles;

an inflow path provided with a common flow path for supplying liquid to the plurality of droplet discharge heads; and a liquid storage portion for supplying a stored liquid to the inflow path and generating negative pressure in the droplet discharge heads, a communication path that communicates liquid between each liquid storage portion of the plurality of droplet discharge units.

2. The droplet discharge apparatus of claim 1, wherein the liquid storage portion is arranged at a position lower than the droplet discharge heads so as to generate negative pressure in the droplet discharge heads.

3. The droplet discharge apparatus of claim 2, further comprising a circulating path for the liquid supplied to the droplet discharge heads to flow back to the liquid storage portion.

4. The droplet discharge apparatus of claim 3, wherein vent holes are disposed so as to open to the atmosphere in an upper wall of the liquid storage portions, such that the liquid in the liquid storage portions is applied with atmospheric pressure and air bubbles generated in the droplet discharge heads are exhausted to the atmosphere through the vent holes when the liquid is circulated.

5. The droplet discharge apparatus of claim 1, wherein the liquid storage portion is configured by a first liquid chamber supplied with liquid; a second liquid chamber, positioned below the first liquid chamber and communicated with the communication path, for supplying the supplied liquid to the inflow path; and a wall with a flow communication hole through which the liquid flows from the first liquid chamber to the second liquid chamber, and further including a differential pressure regulating valve for opening and closing the flow communication hole by the differential pressure of the first liquid chamber and the second liquid chamber, to generate negative pressure in the droplet discharge heads.

6. The droplet discharge apparatus of claim 5, further comprising a circulating path for the liquid supplied to the droplet discharge head to flow back to the second liquid chamber.

7. The droplet discharge apparatus of claim 1, wherein the liquid storage portion is configured by a sealed liquid chamber, communicated with the communication path, for supplying the supplied liquid to the inflow path; and a porous object chamber communicating with the sealed liquid chamber, the porous object chamber stuffed with a porous object, to generate negative pressure in the droplet discharge heads.

8. The droplet discharge apparatus of claim 7, wherein a waste ink tank is connected to the sealed liquid chamber.

9. The droplet discharge apparatus of claim 8, further comprising a circulating path for the liquid supplied to the droplet discharge head to flow back to the sealed liquid chamber.

10. A droplet discharge apparatus comprising:

a plurality of droplet discharge units, further including:

a plurality of droplet discharge heads for discharging droplets from nozzles;

an inflow path including a common flow path for supplying liquid to the plurality of droplet discharge heads;

a liquid storage portion for supplying a stored liquid to the inflow path and generating negative pressure in the droplet discharge heads; and a circulating path for the liquid supplied to the droplet discharge heads to flow back to the liquid storage portion, the liquid storage portion being configured by a first liquid chamber supplied with liquid; a second liquid chamber, positioned below the first liquid chamber and communicated with a communication path, for supplying the supplied liquid to the inflow path; and a wall with a flow communication hole through which the liquid flows from the first liquid chamber to the second liquid chamber, and further including a differential pressure regulating valve for opening and closing the flow communication hole by the differential pressure of the first liquid chamber and the second liquid chamber, and liquid storage portions being communicated by a communication path.

11. The droplet discharge apparatus of claim 10, wherein the liquid supplied to the droplet discharge heads flows back to the second liquid chamber via the circulating path.

12. The droplet discharge apparatus of claim 10, wherein vent holes are disposed so as to open to the atmosphere in an upper wall of the first liquid chamber, such that the liquid in the first liquid chamber is applied with atmospheric pressure and air bubbles generated in the droplet discharge heads are exhausted to the atmosphere through the vent holes when the liquid is circulated.

13. A droplet discharge apparatus comprising:

a plurality of droplet discharge units, further including:

a plurality of droplet discharge heads for discharging droplets from nozzles;

an inflow path including a common flow path for supplying liquid to the plurality of droplet discharge heads;

a liquid storage portion for supplying a stored liquid to the inflow path and generating negative pressure in the droplet discharge heads; and a circulating path for the liquid supplied to the droplet discharge heads to flow back to the liquid storage portion, the liquid storage portion being configured by a sealed liquid chamber, communicated with the communication path, for supplying the supplied liquid to the inflow path; and a porous object chamber communicating with the sealed liquid chamber, the porous object chamber stuffed with a porous object, and a communication path that communicates liquid between each liquid storage portion of the plurality of droplet discharge units.

14. The droplet discharge apparatus of claim 13, wherein a waste ink tank is connected to the sealed liquid chamber.

15. The droplet discharge apparatus of claim 13, wherein the liquid supplied to the droplet discharge heads flows back to the sealed liquid chamber via the circulating path.

* * * * *